United States Patent [19]

Jacobsson

[11] 4,067,508

[45] Jan. 10, 1978

[54] THREAD SUPPLY DEVICE FOR TEXTILE MACHINES

[75] Inventor: Kurt Arne Gunnar Jacobsson, Ulricehamn, Sweden

[73] Assignee: Aktiebolaget IRO, Ulricehamn, Sweden

[21] Appl. No.: 739,723

[22] Filed: Nov. 8, 1976

[30] Foreign Application Priority Data

Nov. 10, 1975 Germany ..... 2550411

[51] Int. Cl.[2] ..... B65H 51/00

[52] U.S. Cl. ..... 242/47.01; 242/47.12; 242/156

[58] Field of Search ..... 242/47.01, 47.12, 128, 242/147 R, 156, 156.1, 156.2

[56] References Cited

U.S. PATENT DOCUMENTS

| | | | |
|---|---|---|---|
| 3,759,300 | 9/1973 | Pfarrwaller | 242/47.01 |
| 3,796,386 | 3/1974 | Tonnert | 242/47.12 |
| 3,834,635 | 9/1974 | Pfarrwaller | 242/47.01 |
| 3,994,446 | 11/1976 | Jacobsson | 242/47.12 |

*Primary Examiner*—Edward J. McCarthy

*Attorney, Agent, or Firm*—Blanchard, Flynn, Thiel, Boutell & Tanis

[57] ABSTRACT

A thread supply device for a textile machine, which device includes a drum on which a thread is wound to form an intermediate thread storage, and from which the thread is withdrawn over one end of the drum for supply to the textile machine. A brake means is disposed adjacent the withdrawal end of the drum and acts on the unwinding thread for imposing a braking effect thereon. The braking means acts progressively on the unwinding thread as it moves peripherally relative to the drum for either increasing or decreasing the braking effect on the thread, depending upon the relative peripheral direction of movement of the thread.

9 Claims, 9 Drawing Figures

THREAD SUPPLY DEVICE FOR TEXTILE MACHINES

BACKGROUND OF THE INVENTION

This invention relates to a thread supply device for textile machines, comprising a drum on which the thread issuing from a supply bobbin can be wound tangentially and withdrawn over the end either by rotation of the drum or, in the case of a stationary drum, by means of a disc-shaped or ring-shaped winding element rotating adjacent a free front drum rim while forming at least one thread winding such that the thread is withdrawn over a removal edge of the drum in the case of a rotating drum and over a sliding edge of the winding element in the case of a stationary drum, and that a thread control element is provided which is arranged stationary adjacent the removal edge in the case of a rotating drum and which serves as a lateral stop for the unwinding thread opposite the direction of movement of the removal edge, and which is located on the winding element adjacent the sliding edge in the case of a stationary drum and which limits the peripheral velocity of the thread unwinding about the sliding edge to the peripheral speed thereof.

A thread supply device of this type is already known from German laid-open print DT-OS 2,312,267 with a rotating drum and from German laid-open print DT-OS 2,345,986 having a stationary drum. In both cases the thread control element prevents the thread removal speed from exceeding the unwinding speed as the thread is unwound from the drum in the direction of the drum axis. Since an off-the-end removal of the thread from the drum is normally used in the case of an intermittent thread supply, the thread control element ensures that a device which is suitable per se for intermittent thread supply can be employed for strictly positive thread supply.

The supply of thread is especially problematical in the case of small-scale jacquard machines. A strict positive thread supply is not expedient for such machines because the thread consumption varies within each repetition of the pattern. For this reason it was hitherto common to use an intermittent thread supply in these machines, but this is not ideal either because the amount of thread consumed for each repetition of the pattern cannot be held constant as would be desired.

The object of the present invention is therefore to develop a thread supply device of the type stated at the outset in which the thread is removed from the drum over the end similar to an intermittent thread supply device, but whose speed of removal is limited to the unwinding speed by a thread control element which laterally engages the unwinding thread in such a manner that in the case of small jacquard machines the amount of thread available to the machine is maintained respectively at a constant level through the repetition of the pattern, but in which fluctuations of thread consumption are possible in narrow limits within the repetition in order to form the pattern.

In accordance with the invention this object is accomplished in that order to use the thread supply device in small jacquard machines, a brake means acting progressively on the unwinding thread in the peripheral direction of the same is disposed in front of the thread control element in the sense of the thread rotating about the removal or sliding edge during the thread removal such that the braking effect is amplified as the thread approaches the thread control element and is decreased as it moves away from the thread control element.

In the case of the thread supply device in accordance with the invention, the maximum amount of thread per unit time which the knitting machine can take up is limited by the thread control element to that amount of thread which is wound on the drum per unit time. In this way the amount of thread consumed per repetition of pattern cannot exceed a specific maximum limit in any case. The thread supply device in accordance with the invention is normally operated on small jacquard machines, however, such that the thread is removed from the drum with a certain amount of angular spacing from the thread control element. If the thread consumption increases, it can approach the thread control element somewhat against the increasing resistance of the braking device, whereas it moves away from the thread control element in the direction of winding with a reduction of the braking effect if the thread consumption decreases. The thread consumption can thus vary somewhat about an average value, these fluctuations being dampened by the increasing and decreasing braking effect and is limited on the one hand by the control element and on the other hand by a common switch-off means if it exceeds the permissible limit. The thread control device in accordance with the invention is thus an intermediate between a purely positive and a purely intermittent thread control device which permits the thread requirements which fluctuate over the small pattern within narrow limits to be met in small jacquard machines, but to strictly limit the amount of thread to a maximum amount over the repetition of pattern.

It is provided in the preferred embodiment of the invention that the brake means have a constant braking effect over an operation angle section of the thread rotation, and that the braking effect increase from the operating angle section toward the thread control element and decrease away from said thread control element. This ensures that in that area in which the thread is noramlly withdrawn from the drum a constant thread tension is exerted on the thread. The braking effect is increased or decreased only when the thread attempts to mvoe out of this normal operating area in order to compensate in this manner for undesired large fluctuation in thread consumption or thread tension.

The brake means is expediently a curved guide part over which the thread passes and is deflected farther out of its path the closer it approaches the thread control element in the direction of thread rotation about the removal or sliding edge during thread removal. The braking effect is achieved in this case with simple structural means by a greater or lesser deflection of the thread out of its path and by corresponding greater or lesser friction exerted on the curved guide part. This is simpler than if another type of brake means were provided, e.g. a spring-action rotatably supported guide arm supporting a guide eye for the thread, although the latter would also be possible.

An especially simple structural design results if the curved guide part is a loop-shaped wire bracket positioned adjacent the removal or sliding edge, through whole interior the unwinding thread passes and which extends the more radially within the removal or sliding edge over its entire effective area the more it approaches the thread control element in the direction of thread rotation about the removal or sliding edge during thread removal. The brake means in this case is a simple wire bracket along whose peripheral the measure of thread deflection and thus the braking effect is varied without any additional structural means by making its radial spacing from the removal or sliding edge greater or smaller.

In the preferred embodiment of the invention, it is provided that the wire bracket has the shaped of a closed loop which forms a stop section forming the thread control element and extending radially relative to the removal or sliding edge and a first brake section connected thereto contrary to the direction of thread rotation during thread removal and having a radial spacing relative to the removal or sliding edge which is reduced as the distance from the stop section increases, an operating section with a constant radial spacing from the removal or sliding edge and a second brake section with a radial spacing from the removal or sliding edge which decreases even further as the distance from the stop section increases, a shut-off section extending externally of the removal or sliding edge and a connecting section between the shut-off and stop sections which is not contacted by the thread in any normally occuring operational phase. In this case, all control functions which affect the thread after its removal from the drum are combined on a simple, loop-shaped wire bracket. The stop section forms the control element which limits the speed of removal to the unwinding speed. Two brake sections extend on both sides of an operational section which the thread passes during normal operation with a constant radial spacing from the removal or sliding edge, a switch-off section being connected to the one brake section. This functions simply in that the braking effect is completely neutralized by reducing the radial spacing of the wire bracket relative to the removal or sliding edge to zero or to a negative value so that a conventional shut-off device can bring the the thread supply device or the textile machine to a standstill. Hence, all control functions are met in this case using the simplest structural means.

DETAILED DESCRIPTION

Figure 1:
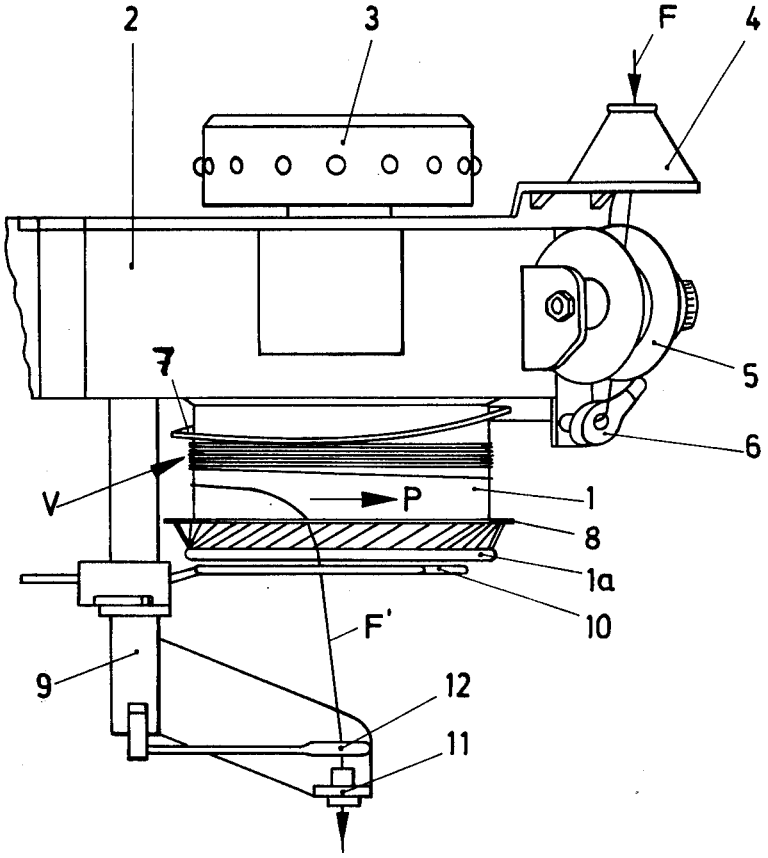
FIG. 1 is a thread supply device with a drum which can be set in rotation.

The thread supply device according to FIG. 1 includes a drum which is rotatably supported in a housing 2. The housing 2 is secured by means (not shown) to a textile machine, in particular a knitting machine, a plurality of supply devices being provided in the knitting machines according to the number of knitting systems. The drum 1 is driven by a pin wheel 3 and a perforated belt (not shown) which cooperates with the pin wheel and which is driven synchronously with the textile machine. The thread F issues from a supply bobbin (not shown), passes through a preliminary brake 4, a disc brake 5 and a thread monitor 6 to be wound tangentially on the drum 1 which rotates in the direction of the arrow P. The thread drum 1 is associated with an inclined advance disc 7 which pushes the forming thread windings in the axial direction of the drum so that an intermediate thread supply V is formed on the drum. The thread is removed from the intermediate thread supply V through a braking ring 8 with elastic fingers and is drawn over the end over a lower removal edge 1*a* of the drum. It subsequently passes through a wire bracket 10 which forms a closed loop and which is secured to a support arm 9 in a stationary manner. A removal eye 11 and a pivotally supported thread monitor 12 are also attached to the support arm 9 coaxial to the axis of the drum 1. The support arm 9 extends external to the thread drum 1 and parallel to its axis and is supported in the housing 2 at one end.

Figure 3:
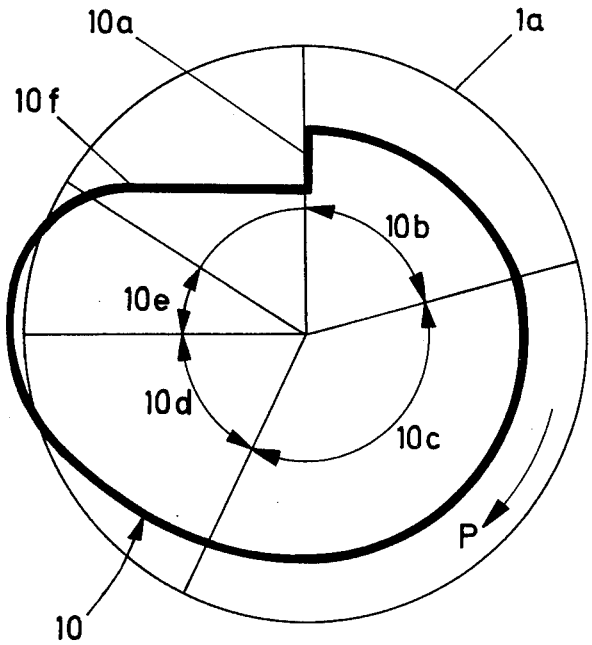
FIG. 3 is a schematic view of a brake means.

FIG. 3 shows a schematic view of the wire bracket 10 as seen from the bottom, i.e. without mounting elements and in its correct position with respect to the removal edge 1*a* of the drum 1 which is indicated by a circle. The wire bracket constitutes a brake means for the unwinding thread and has separate sections of differing form and mode of function. A stop section 10*a* extends radially relative to the removal edge 1*a*. This is followed in the direction of rotation of the drum by a first braking section 10*b* which has a radial spacing relative to the removal edge 1*a* which is decreased as the distance from the stop section increases. The next is an operating section 10*c* with a constant radial spacing from the removal edge and a second braking section which continuously approaches the removal edge in a radial manner. This is followed by a switchoff section 10*e* extending external to the removal edge 1*a* as well as a connecting section 10*f* between the shut-off and the stop section.

Figure 4A:
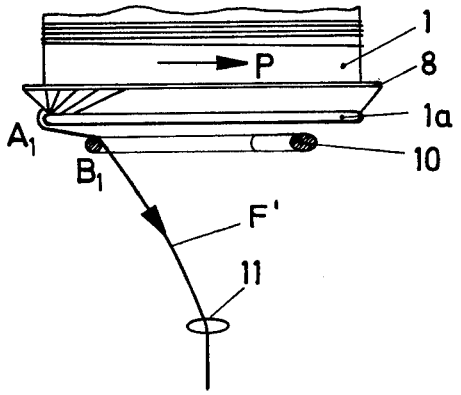
FIG. 4A is a fragmentary side view illustrating the effect of the braking means on the withdrawal thread in the normal operational position, and FIG. 4B diagrammatically illustrates the positional relationship depicted in FIG. 4A, and FIGS. 5A–5B and 6A–6B schematically illustrate in different positions the action of the braking means on the course of the thread.
Figure 4B:
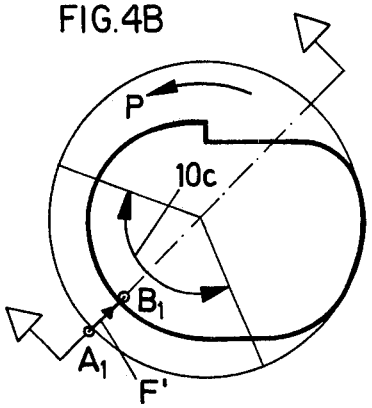
Figure 5A:
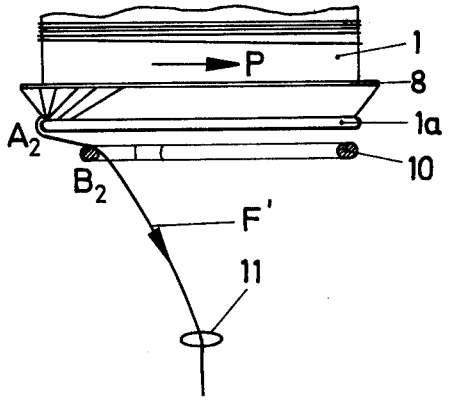
Figure 5B:
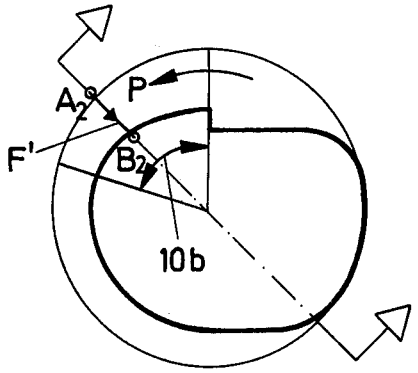
Figure 6A:
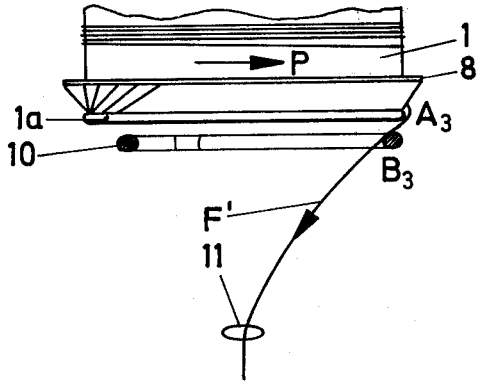
Figure 6B:
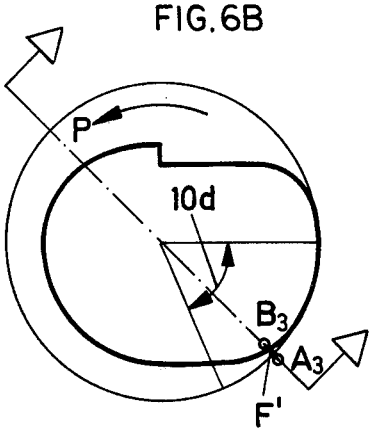

The mode of action of the brake means, i.e. the loop-shaped wire bracket 10, during knitting of small jacquard patterns is described in the following with reference to the schematic drawing in FIGS. 4A–6B which illustrate specific positions. It should be noted in this context that the wire bracket 10 is illustrated in FIGS. 4A–6B from the top, i.e. as seen from the side of the drum, and the removal edge 1*a* of the drum is only shown to illustrate the relative position. The direction of rotation P of the drum is counterclockwise (anticlockwise). The point of thread removal on the removal edge and thus the point of thread contact on the wire bracket migrate in response to the thread requirements of the knitting machine, i.e. the thread tension, such that if requirements are reduced, i.e. the tension decreases, these points migrate in the same sense of direction as the rotation of the drum, whereas if thread requirements increase, i.e. increased tension, these points rotate contrary to the direction of drum rotaton, i.e. counterclockwise. When knitting small jacquard patterns, the thread passes over the point of removal $A_1$ of the removal edge during normal knitting operation and thus passes over the point of contact $B_1$ on the wire bracket 10 which lies in the center of the operating section 10*c*. This position is shown in FIGS. 4A-4B. Migrational movements of the point of removal in the or contrary to the direction of drum rotation caused by small changes in requirements, i.e. tension, are possible without changing the braking force as long as their magnitude is within the area of the operating section. If thread consumption and thus the tension become considerably larger, the thread migrates out of the operational sections 10*c* contrary to the direction of drum rotation into the first braking section 10*b*, e.g. at the point of contact $B_2$ shown in FIGS. 5A–5B which corresponds to a removal point $A_2$. FIG. 5A shows clearly the great extent to which the thread curvature is increased thereby between the removal edge 1*a* and the wire bracket 10, while simultaneously the area of contact on the bracket 10. The braking effect on the thread is increased thereby. Another increase in thread consumption moves the point of thread contact with bracket 10 to the stop section 10*a* where the thread is intercepted and supplied at an unwinding speed corresponding exactly to the winding speed. Thread consumption exceeding this value is thus impossible. On the contrary, if the thread F' unwinding in the operating section 10*c* is under less tension because the machine is consuming less than corresponds to the winding speed of the drum, the point of removal migrates and thus the point of contact migrates also relative to the drum in the direction of rotation until it arrives at the second braking section 10*d*, e.g. at points $A_3$ and $B_3$ in FIGS. 6A–6B. The reversal of the thread between points $A_3$ and $B_3$ are close together, the thread is reversed only a bit and makes contact with the wire bracket 10 only in a small area. The braking effect diminishes. As soon as the thread requirements decrease further or stop completely, the thread moves into the stop section 10*e* in which no braking occurs so that the thread supply device or the textile machine can be shut off by a conventional shut-off device. The connecting section 10*f* between sections 10*a* and 10*e* merely serves to close the loop and is normally not in contact with the thread in any operating position.

Figure 2:
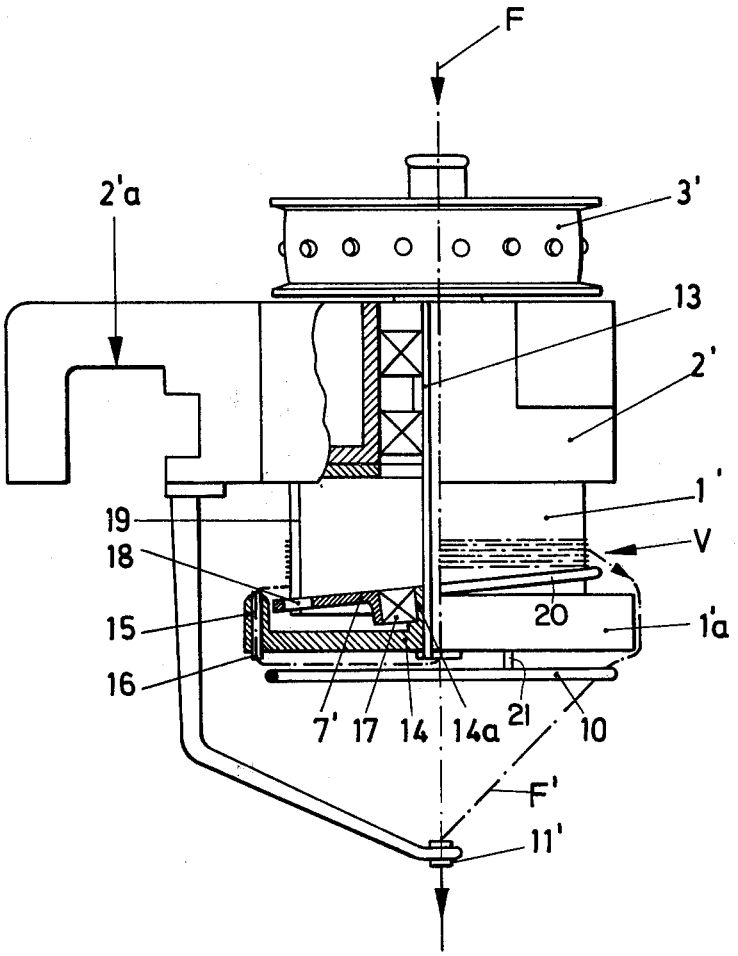
FIG. 2 is a thread supply device with a stationary drum.

FIG. 2 shows a thread supply device with a stationary drum 1' which is non-rotatably affixed to a housing 2'. The housing 2' is adapted to be mounted on the support ring of a textile machine by means of a clamping device indicated schematically at 2'*a*. The drum 1' and the housing 2' are traversed by a hollow shaft 13 onto which a pin wheel 3' is wedged by means of a key. The pin wheel 3' operates together with a perforated drive belt (not shown) in order to set the hollow shaft 13 in rotation. At the lower free end of the hollow shaft 13 a disc 14 is non-rotatably secured which supports on its outer rim a flange-like ring 15 which surrounds the lower free edge of the drum 1'. The ring 15 contains a thread eye 16. Parts 14 to 16 form a rotating winding element for winding the thread F issuing from a supply bobbin (not shown). The thread passes through the hollow shaft 13, is then diverted radially outwardly, passes through the thread eye 16 and from here is wound on the drum 1' tangentially. A ball bearing 17 is supported in an inclined position on the hub 14*a* of the disc 14. An advance disc 7' rotates about said ball bearing and engages outwardly in the jacket of the drum 1' by arms 18 extending through longitudinal slots 19. The arms 18 are interconnected externally by a ring 20. The arrangement is selected such that the advance disc 7' maintains its inclined spacial position so that it advances the thread windings wound upon the drum 1' upwardly in the axial direction of the drum so that an intermediate thread storage V is provided on the drum. From this intermediate thread storage, the thread is removed from the drum 1' over the end as indicated at F'. In so doing, it passes over the outer surface of the ring 15 which forms a sliding edge 1'*a*, through a wire bracket 10 to a central removal eye 11'. The wire bracket 10 has the same shape as that illustrated in FIG. 3. It is secured to the disc 14 by means of mounting elements 21 in such a spaced relation that it does not impede the course of the thread between the hollow shaft 13 and the thread eye 16. The mode of function of the wire bracket 10 as a braking means for the thread removal during knitting of small jacquard patterns is the same as the mode of functon already described with reference to FIGS. 4A–6B, irrespective of the fact that the relative movement between the drum 1' and the wire bracket 10 is produced by the drum 1' remaining stationary and the wire bracket 10 rotating together with the winding element 14.

What is claimed is:

1. A thread supply device for textile machines, comprising a drum on which the thread issuing from a supply bobbin can be wound tangentially and withdrawn over the end either by rotation of the drum or, in the case of a stationary drum, by means of a disc-shaped or ring-shaped winding element rotating adjacent a free front drum rim while forming at least one thread winding such that the thread is withdrawn over a removal edge of the drum in the case of a rotating drum and over a sliding edge of the winding element in the case of a stationary drum, and that a thread control element is provided which is arranged stationary adjacent the removal edge in the case of a rotating drum and which serves as a lateral stop for the unwinding thread opposite the direction of movement of the removal edge, and which is located on the winding element adjacent the sliding edge in the case of a stationary drum and which limits the peripheral velocity of the thread unwinding about the sliding edge to the peripheral speed thereof, characterized in that, in order to use the thread supply device in small jacquard machines, a brake means acting progressively on the unwinding thread in the peripheral directon of the same is disposed in front of the thread control element in the sense of the thread rotation about the removal or sliding edge during thread removal such that the braking effect is amplified as the thread approaches the thread control element and is decreased as the thread moves away from the thread control element.

2. A thread supply device according to claim 1, wherein the brake means has a constant braking effect over an operating angle section of the thread rotation, and wherein the brake means has first and second variable braking angle sections disposed on opposite sides of the operating angle section such that the braking effect (1) increases as the thread moves from the operating angle section toward the thread control element into the first braking angle section and (2) decreases as the thread moves from the operating angle section away from said thread control element into the second braking angle section.

3. A thread supply device according to claim 1, wherein the brake means is a curved guide part over which the unwinding thread passes and is deflected farther out of its path the closer it approaches the thread control element in the direction of thread rotation about the removal or sliding edge during thread removal.

4. A thread supply device according to claim 3, wherein the curved guide part is a loop-shaped wire bracket positioned adjacent the removal or sliding edge, through whose interior the unwinding thread passes.

5. A thread supply device according to claim 4, wherein the wire bracket has the shape of a closed loop and includes (1) a stop section extending radially relative to the normal or sliding edge, the stop section defining said thread control element, (2) a first brake section connected to the stop section and extending circumferentially therefrom contrary to the direction of thread rotation during thread removal and having a radial spacing relative to the removal or sliding edge which is reduced as the distance from the stop section increases, (3) an operating section with a constant radial spacing from the removal or sliding edge, (4) a second brake section with a radial spacing from the removal or sliding edge which decreases even further as the circumferential distance from the stop section increases, (5) a shut-off section extending externally of the removal or sliding edge, and (6) a connecting section between the shut-off and stop sections which is not contacted by the thread in any normally occurring operational phase.

6. In a thread supply device for a textile machine, comprising a cylindrical drum structure on which a thread issuing from a supply bobbin can be wound tangentially and from which the thread can be withdrawn over one end, a winding structure for causing the thread to be wound on the drum structue, one of said structure being rotatable relative to the other of said structures about the longitudinal axis of said drum structure, and a stop structure disposed adjacent said one end of the drum structure and fixedly related to said winding structure for limiting the relative peripheral velocity between the drum structure and the withdrawn thread as the latter is removed from the drum structure and tends to move peripherally relative to said one end of said drum structure, the improvement wherein braking means is fixedly related relative to said stop structure and coacts with the withdrawn thread as it is unwound from said drum structure for applying a braking effect thereto, said braking means including a first brake portion extending peripherally of the drum structure adjacent said one end thereof for imposing a progressively increased braking effect on the withdrawn thread as the latter moves peripherally relative to the drum structure in a direction toward the stop structure, and said braking means including a second brake portion extending peripherally of said one end of said drum structure for progressively imposing a decreased braking effect on the withdrawn thread as it moves peripherally relative to the drum structure in a direction away from the stop structure.

7. A thread supply device according to claim 6, wherein said braking means includes a central operating portion disposed circumferentially between said first and second brake portions, said central operating portion extending peripherally with respect to said drum structure through a preselected angle, said central operating portion applying a substantially constant braking effect on the withdrawn thread.

8. A thread supply device according to claim 7, wherein one of said brake portions extends circumferentially of said drum structure away from one end of said central operating portion, said one brake portion extending progressively radially outwardly as it projects circumferentially away from said operating portion, and the other brake portion extending circumferentially of said drum structure away from the other end of said central operating portion, said other brake portion progressively projecting radially inwardly as it projects circumferentially away from said central operating portion, and said central operating portion being of a substantially constant radius as defined about the axis of said drum structure.

9. A thread supply device according to claim 8, wherein said braking means and said stop structure together form a single endless loop positioned adjacent said one end of the drum structure for engaging the withdrawn thread and for controlling the peripheral displacement thereof relative to said drum structure.

* * * * *

UNITED STATES PATENT AND TRADEMARK OFFICE

CERTIFICATE OF CORRECTION

PATENT NO. : 4 067 508

DATED : January 10, 1978

INVENTOR(S) : Kurt Arne Gunnar Jacobsson

It is certified that error appears in the above-identified patent and that said Letters Patent are hereby corrected as shown below:

Column 6, Line 65; change "normal" to ---removal---.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*